US010786821B2

(12) United States Patent
Roos et al.

(10) Patent No.: US 10,786,821 B2
(45) Date of Patent: Sep. 29, 2020

(54) SYSTEMS AND METHODS FOR COATING WITH SHEAR AND MOISTURE SENSITIVE MATERIALS

(71) Applicant: NORDSON CORPORATION, Westlake, OH (US)

(72) Inventors: John Roos, Wakeman, OH (US); Todd Frenk, Amherst, OH (US); Robert Sims, Bowling Green, OH (US); Benjamin S. Price, Elyria, OH (US)

(73) Assignee: Nordson Corporation, Westlake, OH (US)

( * ) Notice: Subject to any disclaimer, the term of this patent is extended or adjusted under 35 U.S.C. 154(b) by 171 days.

(21) Appl. No.: 16/050,175

(22) Filed: Jul. 31, 2018

(65) Prior Publication Data

US 2020/0038883 A1 Feb. 6, 2020

(51) Int. Cl.
*B05B 1/02* (2006.01)

(52) U.S. Cl.
CPC ..... *B05B 1/02* (2013.01)

(58) Field of Classification Search
None
See application file for complete search history.

(56) References Cited

U.S. PATENT DOCUMENTS

2004/0219288 A1* 11/2004 Hayashi ..... H01L 21/6715 427/8
2005/0181142 A1* 8/2005 Hirano ..... B05B 5/001 427/421.1
2007/0028839 A1* 2/2007 Saigusa ..... H01J 37/32477 118/715
2016/0184839 A1* 6/2016 Tian ..... H01L 21/6708 438/745

FOREIGN PATENT DOCUMENTS

WO 2005/016552 A2 2/2005

* cited by examiner

*Primary Examiner* — Nathan T Leong
(74) *Attorney, Agent, or Firm* — Baker & Hostetler LLP

(57) ABSTRACT

Methods and systems for coating with shear and moisture sensitive materials are disclosed. A method of coating a product includes filling an inner bellows chamber of a bellows, which is provided within and isolated from an outer bellows chamber of a tank, with a predetermined amount of the coating material. The method of coating the product further includes supplying a pressurized material to the outer bellows chamber to pressurize the coating material within the inner bellows chamber to an operating pressure, and supplying the coating material within the inner bellows chamber to a spray gun at the operating pressure. The method of coating also includes determining that a measured actual pressure is within a predetermined control range of the target pressure and subsequently coating the product by spraying the product with the coating material from the spray gun.

21 Claims, 5 Drawing Sheets

SYSTEMS AND METHODS FOR COATING WITH SHEAR AND MOISTURE SENSITIVE MATERIALS

TECHNICAL FIELD

The present invention generally relates to coating systems and methods that minimize exposure of the coating material to shear forces and moisture.

BACKGROUND

Known coating systems typically employ at least one pump (e.g., a dual action piston pump) that directly pumps the coating material at relatively high pressures to a spray gun for coating. That is, the pressure of the coating material supplied to the spray gun is directly controlled by the pump that pumps the coating material throughout the system. Though these known coating systems have been effective at accurately controlling the pressure of the coating material sprayed from the spray gun, such systems suffer from numerous drawbacks.

For example, the pump and associated control mechanisms include a number of fixed orifices through which the coating material must pass before being sprayed from the spray gun. Passing the coating material through such fixed orifices results in significant pressure drops that can cause shearing of the coating material. In addition, known coating systems include an unacceptable amount of opportunities for exposing the coating material to moisture. Further, soft packing and/or solvent associated with the pump that directly pumps the coating material may mix with the coating material as the coating material is pumped through the coating system, which may lead to unacceptable contamination of the coating material. These issues may be exacerbated for coating materials having properties that are particularly sensitive to shear forces, moisture, contaminants, etc.

Accordingly, there exists a need for improved systems and methods for coating that minimize exposure of the coating material to shear forces, moisture, and/or contaminants.

SUMMARY

These needs are met, to a great extent, by a method of coating a product that includes receiving a target pressure for a coating material at a spray gun and filling an inner bellows chamber of a bellows, which is provided within and isolated from an outer bellows chamber of a tank, with a predetermined amount of the coating material. The method also includes supplying, subsequent to the filling of the inner bellows chamber with the predetermined amount of the coating material, a pressurized material to the outer bellows chamber to pressurize the coating material within the inner bellows chamber to an operating pressure, and supplying the coating material within the inner bellows chamber to the spray gun at the operating pressure. The method further includes measuring an actual pressure at the spray gun, comparing the actual pressure measured at the spray gun to the target pressure, and determining that the operating pressure is within a predetermined control range of the target pressure. Finally, the method includes subsequently coating the product by spraying the product with the coating material from the spray gun.

A coating system for coating with shear and moisture sensitive materials is also disclosed. The coating system includes a pressurized material supply system including a pressurized material supply that is configured to contain a pressurized material and a pressure regulator in fluid communication with the pressurized material supply and that is configured to receive the pressurized material from the pressurized material supply and to regulate a pressure of the pressurized material to a regulated pressure.

The coating system also includes a coating material supply system having a pressure pot that is configured to contain a coating material. The coating material supply system also includes a bellows tank assembly having a tank with an outer bellows chamber configured to fluidly communicate with the pressure regulator such that the outer bellows chamber is configured to receive the pressurized material from the pressure regulator at the regulated pressure. The bellows tank assembly also has a bellows that is provided within the outer bellows chamber, the bellows includes an inner bellows chamber that is isolated from the outer bellows chamber and that has a volume that is configured to expand or contract, the inner bellows chamber is configured to fluidly communicate with the pressure pot to receive the coating material from the pressure pot.

The coating system further includes a spray gun that is configured to fluidly communicate with the inner bellows chamber to receive the coating material from the inner bellows chamber and to spray the coating material, the spray gun comprising a pressure sensor that is configured to measure an actual pressure of the coating material at the spray gun. The coating system also has a controller that is in electronic communication with the pressure regulator and the pressure sensor. The controller is configured to control operation of the pressure regulator to adjust the regulated pressure of the pressurized material supplied to the outer bellows chamber based upon the actual pressure of the coating material measured by the pressure sensor to thereby adjust the actual pressure of the coating material at the spray gun.

A coating system is disclosed that includes a supply of coating material, a supply of pressurized gas which does not impart moisture to the coating material, a pressurized material supply system, a bellows tank assembly that receives pressurized coating material from the outlet of the pressure vessel, a pressure regulator that sets the pressure of the coating material in the bellows tank assembly, and a spray gun. The pressurized material supply system includes a pressure vessel having an inlet for the coating material that is connected to said supply of coating material, an outlet for the coating material, and an inlet for pressurized gas in an upper portion of the pressure vessel that is connected to the supply of pressurized gas. The pressurized gas in the upper portion of the pressure vessel pushes the coating material out of the outlet of the pressure vessel. The bellows tank assembly supplies pressurized coating material to the spray gun.

Various additional features and advantages of this invention will become apparent to those of ordinary skill in the art upon review of the following detailed description of the illustrative embodiments taken in conjunction with the accompanying drawings.

BRIEF DESCRIPTION OF THE DRAWINGS

The following detailed description is better understood when read in conjunction with the appended drawings. For the purposes of illustration, examples are shown in the drawings; however, the subject matter is not limited to the specific elements and instrumentalities disclosed. In the drawings.

DETAILED DESCRIPTION OF ILLUSTRATIVE EMBODIMENTS

Figure 1:
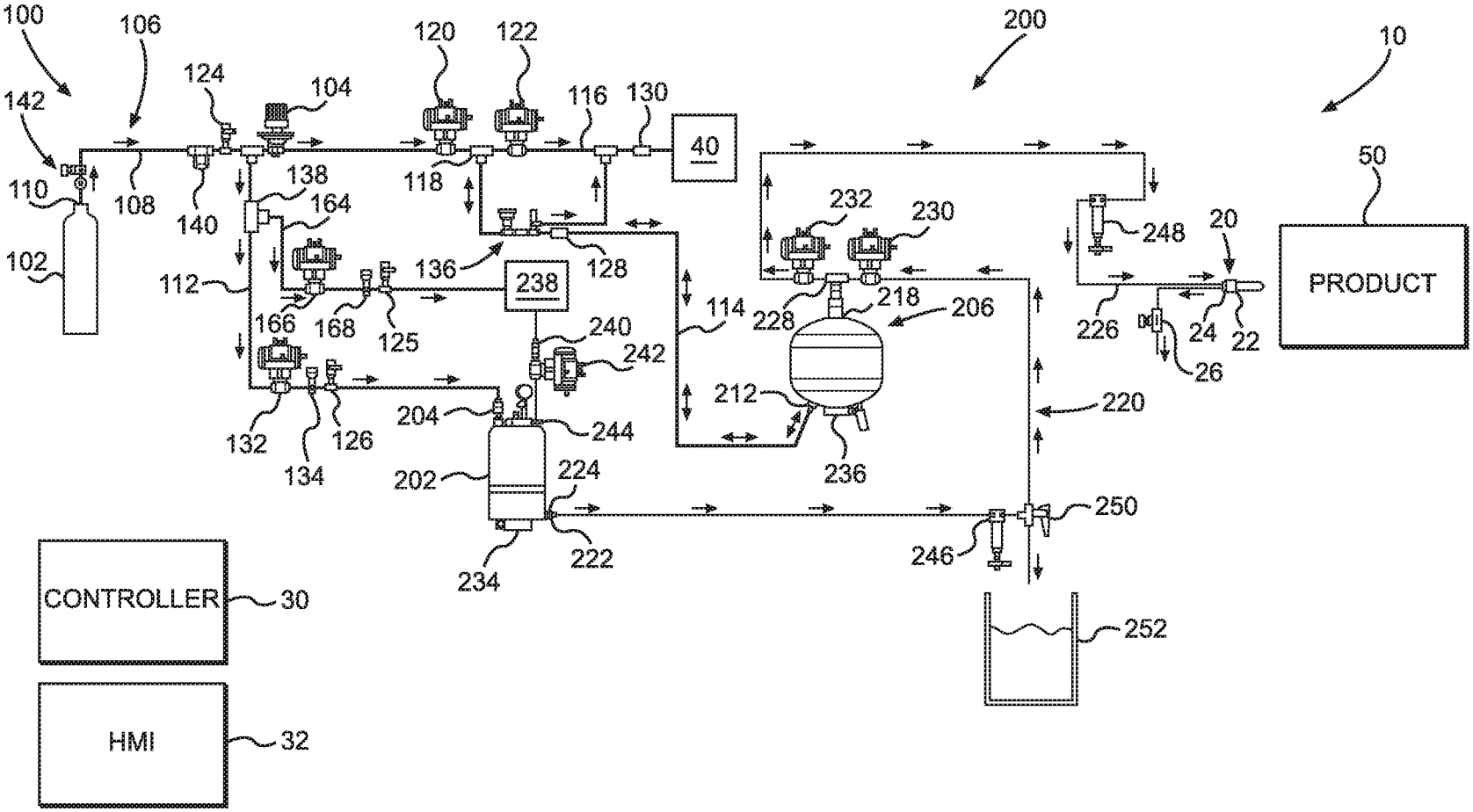
FIG. 1 illustrates a schematic overview of a coating system in accordance with aspects of the invention.
Figure 2:
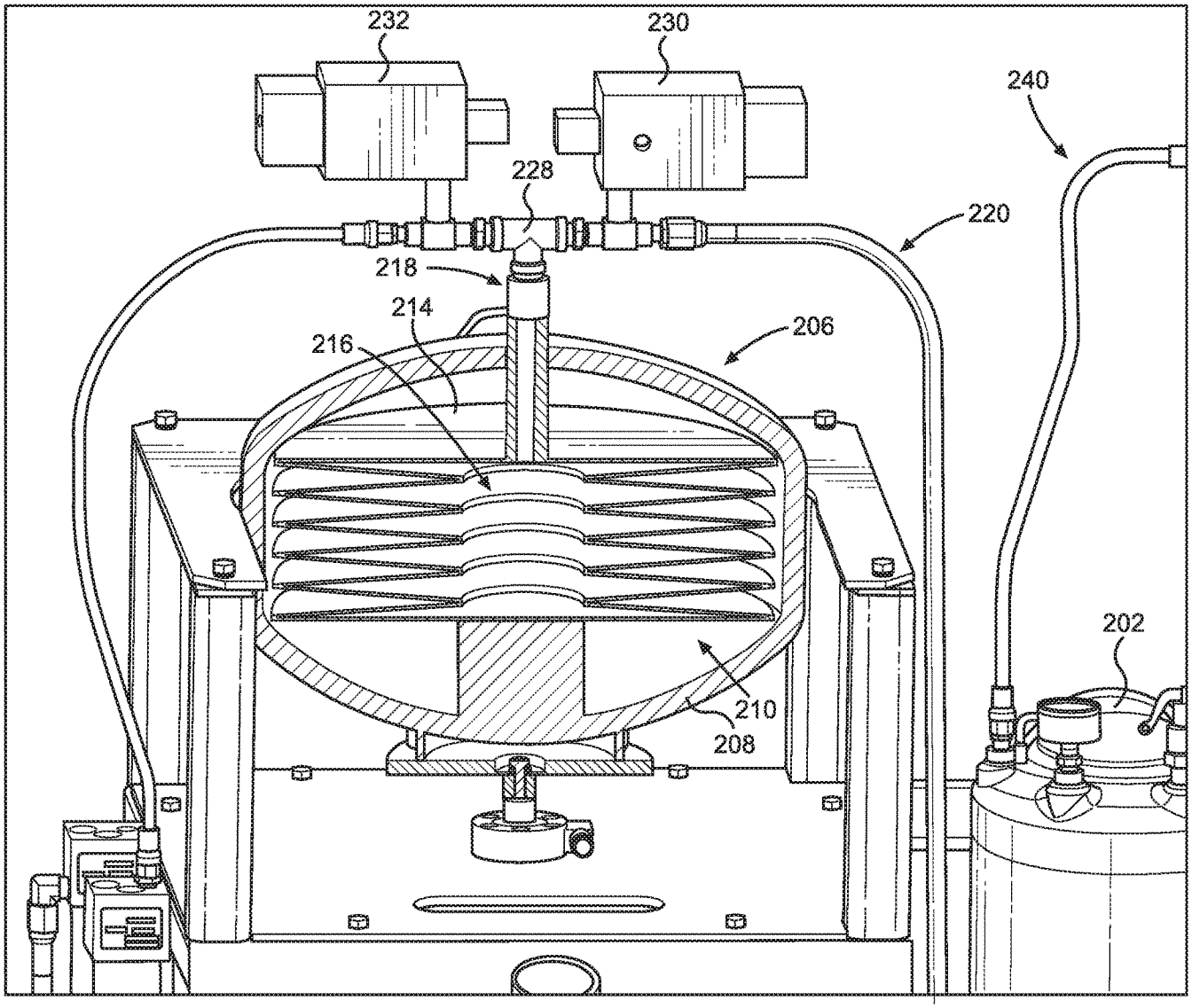
FIG. 2 illustrates aspects of an exemplary embodiment of the coating system including a cut-away view of the bellows tank assembly in accordance with aspects of the invention.
Figure 3:
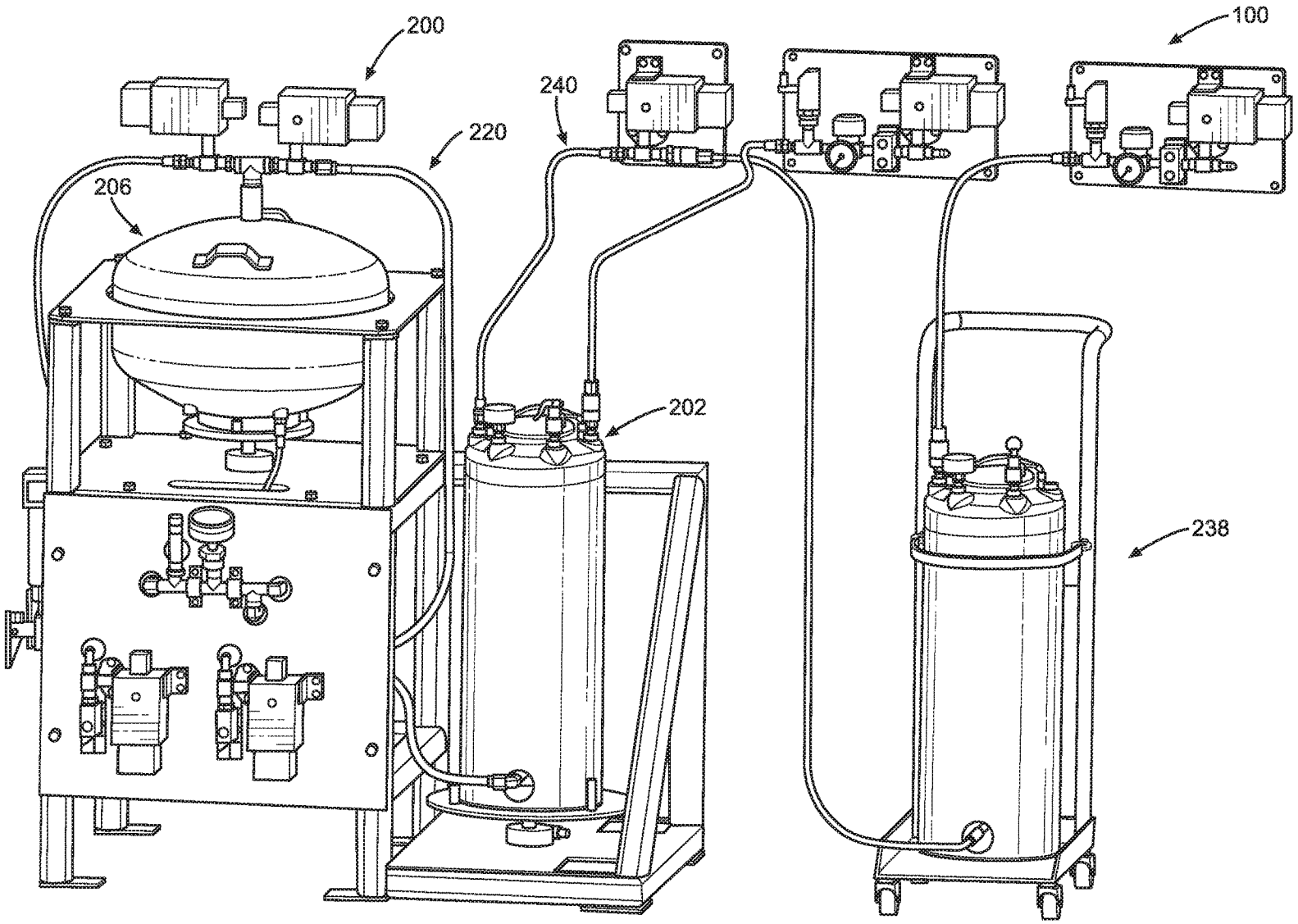
FIG. 3 illustrates an exemplary embodiment of the coating system including a mobile coating material supply in accordance with aspects of the invention.
Figure 4:
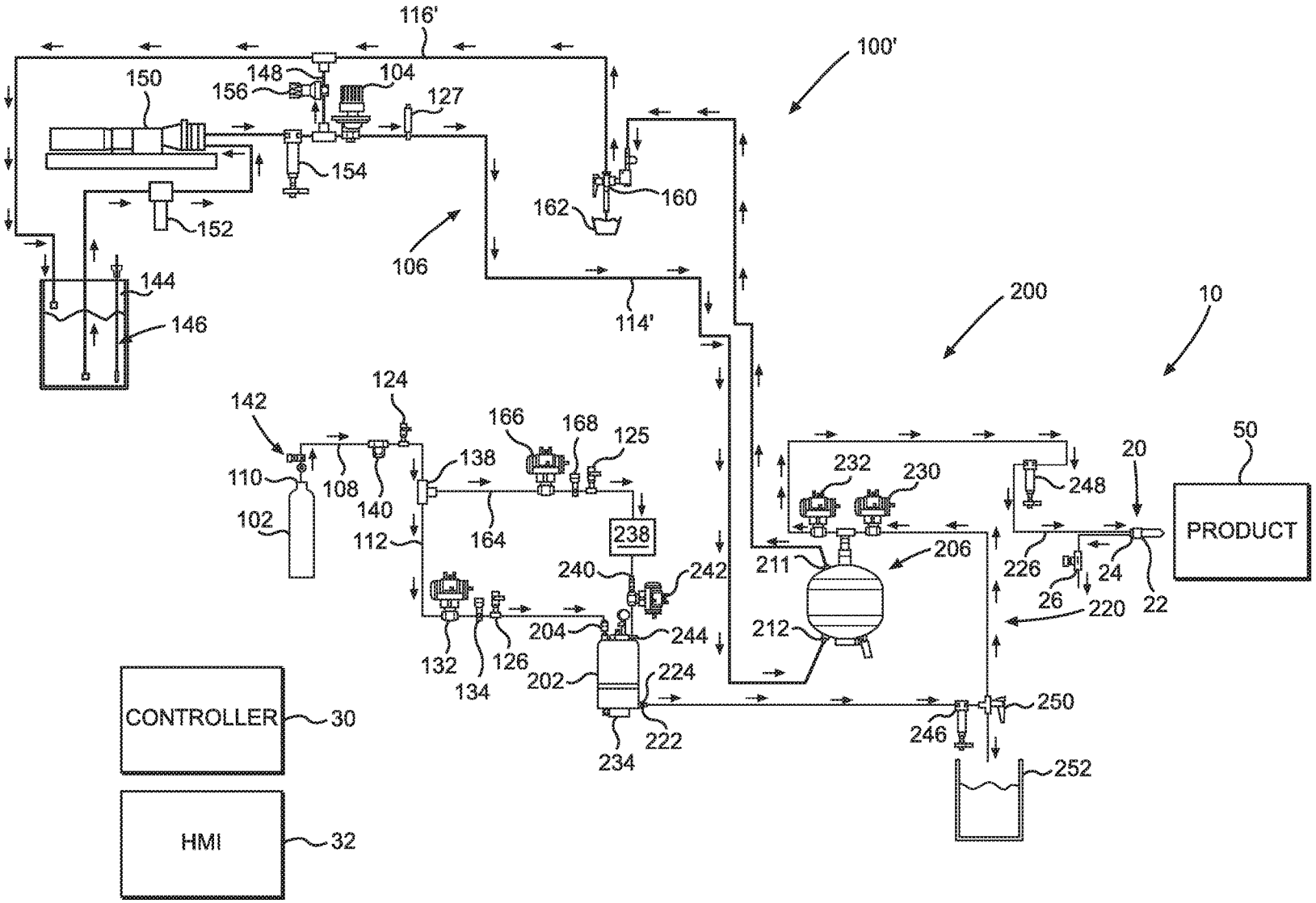
FIG. 4 illustrates an exemplary embodiment of the coating system including an alternate pressurized material supply system in accordance with aspects of the invention.

FIGS. 1-4 show aspects of a coating system 10 in accordance with the invention. FIG. 1 illustrates a schematic overview of the coating system 10 in accordance with aspects of the invention. FIG. 2 illustrates aspects of an exemplary embodiment of the coating system 10 including a cut-away view of a bellows tank assembly 206 of the coating system 10. FIG. 3 illustrates the exemplary embodiment of the coating system 10 including a coating material supply 238. FIG. 4 illustrates the coating system 10 equipped with an alternate pressurized material supply system 100'.

As shown in FIG. 1, the coating system 10 may include a pressurized material supply system 100. The pressurized material supply system 100 may have a pressurized material supply 102 that may contain a pressurized material. The pressurized material may, for example, be an inert fluid or gas such as, e.g., argon, nitrogen, mixtures thereof, etc. The pressurized material supply system 100 may further include a pressure regulator 104 that may be in fluid communication with the pressurized material supply 102. Fluid communication, as used herein, may mean that two or more structures are connected, directly or indirectly, in a manner (e.g., via hoses, valves, conduits, connectors, etc.) that permits fluid and/or gas to move from one structure to the other structure (s). The pressure regulator 104 may receive the pressurized material from the pressurized material supply 102 and may regulate a pressure of the pressurized material to a regulated pressure. For example, the pressure regulator 104 may regulate the pressure of the pressurized material by venting the pressurized material received from the pressurized material supply 102. The pressure regulator 104 may regulate the pressure of the pressurized material to a pressure between, e.g., 10-1,000 psi.

The coating system 10 may further include a coating material supply system 200. The coating material supply system 200 may include a pressure pot 202 that may contain a coating material. The coating material may be any desired coating material capable of flowing through the coating system 10 and may have properties that are sensitive to, e.g., moisture exposure, shear forces, light exposure, etc. That is, properties of the coating material may change when exposed to moisture, shear forces, light, and/or contaminants. The pressure pot 202 may comprise a stainless steel day tank having a capacity of, e.g., 2-10 gallons. The pressure pot 202 may further comprise a relief valve (not shown) that prevents pressure accumulation within the pressure pot 202 beyond a predetermined maximum pressure. For example, the relief valve may vent the pressurized material if pressure within the pressure pot 202 exceeds, e.g., 5 psi. The pressure pot 202 may also comprise an outlet 224 for supplying the coating material to other structures of the coating material supply system 200. The pressure pot 202 may include an inlet 204 that may fluidly communicate with the pressurized material supply 102 such that the pressure pot 202 may receive the pressurized material from the pressurized material supply 102 to provide a blanket of the pressurized material above the coating material contained within the pressure pot 202. The blanket of the pressurized material may permit flow of the coating material from the pressure pot 202. Further, because the pressurized material may be an inert gas, exposure to moisture is minimized thus protecting the properties of the coating material as the coating material within the pressure pot 202.

As shown in FIGS. 1 and 2, the coating material supply system 200 may further include a bellows tank assembly 206. The bellows tank assembly 206 may include a tank 208 having an outer bellows chamber 210 that may fluidly communicate with the pressure regulator 104 such that the outer bellows chamber 210 may receive the pressurized material from the pressure regulator 104 at the regulated pressure. The tank 208 may further include an opening 212 in fluid communication with the pressurized material supply system 100. The pressurized material may be supplied to/ejected from the outer bellows chamber 210 of the tank 208 via the opening 212. The bellows tank assembly 206 may further include a bellows 214 provided within the outer bellows chamber 210 of the tank 208. The bellows 214 may include an inner bellows chamber 216 that is isolated from the outer bellows chamber 210 of the tank 208 and that has a volume that may expand or contract. The inner bellows chamber 216 of the bellows 214 may fluidly communicate with the pressure pot 202 to receive the coating material from the pressure pot 202. The bellows 214 may also include an opening 218 in fluid communication with the coating material supply system 200. The coating material may be supplied to/ejected from the inner bellows chamber 216 of the bellows 214 via the opening 218. According to aspects of the invention, the pressure of the coating material contained within the inner bellows chamber 216 of the bellows 214 may be a function of the pressure of the pressurized material supplied to the outer bellows chamber 210 of the tank 208. That is, the pressurized material within the outer bellows chamber 210 of the tank 208 may cause an expansion and/or contraction of the bellows 214, also contained within the outer bellows chamber 210 of the tank 208, which may thereby control the pressure of the coating material isolated within the bellows 214. Pressure control in this manner minimizes the application of shear forces to the coating material and allows the coating material to remain isolated from moisture, contaminants, light, etc.

Returning to FIG. 1, the coating system 10 may also include a spray gun 20 that may fluidly communicate with the inner bellows chamber 216 of the bellows 214 to receive the coating material from the inner bellows chamber 216 of the bellows 214 and to spray the coating material onto, e.g., a product 50. The product 50 may, for example, be a container. The spray gun 20 may include a pressure sensor 22 (e.g., a pressure transducer, a pressure transmitter, and/or a pressure switch) that may measure an operating pressure of the coating material at the spray gun 20. The coating system 10 may further include a controller 30 that is in electronic communication (e.g., via wired and/or wireless connections) with, e.g., the pressure regulator 104 and the pressure sensor 22. The controller 30 may automatically control operation of the pressure regulator 104 to adjust the regulated pressure of the pressurized material supplied to the outer bellows chamber 210 of the tank 208 of the bellows tank assembly 206 based upon the actual pressure of the coating material measured by the pressure sensor 22 to thereby adjust the actual pressure of the coating material at the spray gun 20. For example, the pressure sensor 22 may generate a coating material pressure output (e.g., an electronic signal) corresponding to the measured pressure of the coating material supplied to the spray gun 20 and may transmit the coating material pressure output to the controller 30. The coating material pressure output may be used by the controller 30 to control spraying of the coating material from the spray gun 20.

Accordingly to aspects of embodiments of the invention, because the operating pressure of the coating material may be controlled by regulating the pressure of the pressurized material supplied to the outer bellows chamber 210 of the tank 208, rather than directly regulating the pressure of the coating material via, e.g., a pump, the coating material may remain isolated within the inner bellows chamber 216 of the bellows 214 during pressurization. Therefore, exposure of the coating material to, e.g., moisture, light, and/or contaminants may be minimized or eliminated. In addition, because the operating pressure of the coating material may be controlled while the coating material is isolated within the inner bellows chamber 216 of the bellows 214, the coating system 10 obviates the need for a pump to directly pump the coating material to control the operating pressure of the coating material. Accordingly, fixed orifices associated with the pump may be eliminated, which may thereby reduce exposure of the coating material to shear forces. Further potential sources of contamination (e.g., soft packing and/or solvent associated with the pump) may also be eliminated by obviating the need for directly pumping the coating material to control the operating pressure of the coating material. In addition, the life span of the coating system 10 may be improved by eliminating the need for the pump, which includes components that wear over time. Accordingly, the coating system 10 (and, e.g., the process 400 of coating described below) may accurately control the pressure of the coating material sprayed from the spray gun 20 while minimizing exposure of the coating material to shear forces, moisture, and/or contaminants.

In embodiments of the invention, the pressurized material supply system 100 may further include a pressurized material supply line 106 that the pressurized material may flow through. The pressurized material supply line 106 may convey the pressurized material throughout the pressurized material supply system 100 and enable fluid and/or gas communication between various structures of the pressurized material supply system 100 and, in some case, between structures of the coating material supply system 200. The pressurized material supply line 106 may comprise, for example, seamless stainless steel tubing, PTFE SSTL braided hoses, etc., and may be rated to safely convey the pressurized material at pressures that may reach, for example, 3,000 psi.

The pressurized material supply line 106 may include a first branch 108 that is connected to an opening 110 of the pressurized material supply 102. The pressurized material supply line 106 may further include a second branch 112 that is connected to the first branch 108 and to the inlet 204 of the pressure pot 202. The pressurized material supply line 106 may also include a third branch 114 that is connected to the first branch 108 and to the opening 212 of the outer bellows chamber 210 of the tank 208 of the bellows tank assembly 206. The pressure regulator 104 may be provided along and in fluid communication with the third branch 114. Provided along and in fluid communication with, as used herein, may mean interposed between segments of the respective branch so as to receive fluid from and transfer fluid to the segments of the branch. The pressurized material supply line 106 may also include a fourth branch 116 that is connected to the third branch 114 at a branch connection 118 between the pressure regulator 104 and the opening 212 of the outer bellows chamber 210 of the tank 208 of the bellows tank assembly 206. The fourth branch 116 may also be connected to an exhaust 40.

The pressurized material supply system 100 may further include a tank supply valve 120. The tank supply valve 120 may be provided along and in fluid communication with the third branch 114 of the pressurized material supply line 106. The tank supply valve 120 may be interposed between the pressure regulator 104 and the opening 212 of the outer bellows chamber 210 of the tank 208 of the bellows tank assembly 206. Actuation of the tank supply valve 120, which may be automatically controlled by the controller 30, may selectively prevent or permit fluid communication between the pressurized material supply 102 and the opening 212 of the outer bellows chamber 210 of the tank 208 of the bellows tank assembly 206. For example, the tank supply valve 120 may be a two-way ball valve that, when opened, may permit flow of the pressurized material from the pressurized material supply 102 to, e.g., the bellows tank assembly 206. When closed, the tank supply valve 120 may prevent flow of the pressurized material from the pressurized material supply 102 to, e.g., the bellows tank assembly 206, and vice versa. The tank supply valve 120 may, for example, be pneumatically, hydraulically, and/or electrically actuated.

The pressurized material supply system 100 may also include an exhaust valve 122. The exhaust valve 122 may be provided along and in fluid communication with the fourth branch 116 of the pressurized material supply line 106. The exhaust valve 122 may be interposed between the branch connection 118 and the exhaust 40. Actuation of the exhaust valve 122, which may be automatically controlled by the controller 30, may selectively prevent or permit fluid communication between the opening 212 of the outer bellows chamber 210 of the tank 208 of the bellows tank assembly 206 and the exhaust 40. For example, the exhaust valve 122 may be a two-way ball valve that, when opened, may permit flow of the pressurized material from the bellows tank assembly 206 to the exhaust 40. Permitting flow of the pressurized material from the bellows tank assembly 206 may, for example, facilitate filling of the bellows 214 with the coating material by allowing the expanding bellows 214 to freely displace pressurized material from the outer bellows chamber 210 of the tank 208 of the bellows tank assembly 206 and to the exhaust 40. When closed, the exhaust valve 122 may prevent flow of the pressurized material from the bellows tank assembly 206 to the exhaust 40. The exhaust valve 122 may, for example, be pneumatically, hydraulically, and/or electrically actuated.

The pressurized material supply system 100 may further include one or more pressure sensor for measuring pressures of the pressurized material at different positions throughout the pressurized material supply system 100. The pressure sensor(s) may comprise, for example, a pressure transducer, a pressure transmitter, and/or a pressure switch. Further, the pressure sensor(s) may be in electronic communication (e.g., via wired and/or wireless connections) with the controller 30 such that pressure measurements may be transmitted to the controller 30. For example and as shown in FIGS. 1 and 4, pressure sensor(s) 124, 125, 126, 127 may be respectively provided along and in fluid communication with various branches of the pressurized material supply line 106.

The pressurized material supply system may include local spray pressure control, such as is available from Nordson and marketed as the "Spray Pressure Control System." The local spray pressure control may work in concert with the controller 30 and the pressure regulator 104 to provide consistent control of the pressure of the pressurized material. The local spray pressure control may comprise, for example, a first flow control fixed orifice 128 for controlling flow of the pressurized material through the third branch 114. The local spray pressure control may further comprise a second flow control fixed orifice 130 for controlling flow through the fourth branch 116. In embodiments not shown, the local spray pressure control may include a pressure regulator, a pressure gauge, a circulation manifold having a fixed orifice and an in-line filter, and/or a 3-way ball valve. The local spray pressure control may generate a pressurized material pressure output (e.g., an electronic signal) corresponding to the pressure of the pressurized material supplied to the bellows tank assembly 206 and may transmit the pressurized material pressure output to the controller 30. The pressurized material pressure output may be used by the controller 30 to control spraying of the coating material from the spray gun 20.

The pressurized material supply system 100 may also include a blanket supply valve 132. The blanket supply valve 132 may be provided along and in fluid communication with the second branch 112 of the pressurized material supply line 106. The blanket supply valve 132 may be interposed between the pressurized material supply 102 and the inlet 204 of the pressure pot 202. Actuation of the blanket supply valve 132, which may be automatically controlled by the controller 30, may selectively prevent or permit fluid communication between the pressurized material supply 102 and the inlet 204 of the pressure pot 202. For example, the blanket supply valve 132 may be a two-way ball valve that, when opened, may permit flow of the pressurized material from the pressurized material supply 102 to the pressure pot 202 to provide the blanket of pressurized material above the coating material contained within the pressure pot 202. When closed, the blanket supply valve 132 may prevent flow of the pressurized material from the pressurized material supply 102 to the pressure pot 202. The blanket supply valve 132 may, for example, be pneumatically, hydraulically, and/or electrically actuated.

The pressurized material supply system 100 may further include a pressure pot regulator 134 that may regulate (e.g., automatically via instruction from the controller 30) the pressure of the pressurized material supplied to the pressure pot 202. The pressure pot regulator 134 may regulate the pressure of the pressurized material supplied to the pressure pot 202 by venting the pressurized material received from the pressurized material supply 102. The pressure pot regulator 134 may regulate the pressure of the pressurized material supplied to the pressure pot 202 to a constant pressure and/or may variably control the pressure based upon instruction from the controller 30.

The pressurized material supply system 100 may further include a safety 136 provided along and in fluid communication with the third branch 114 of the material supply line 106. The safety 136 may ensure that the pressure of the pressurized material supplied to the bellows tank assembly 206 does not exceed a predetermined maximum pressure, e.g., 900 psi. The safety 136 may comprise, for example, a pressure gauge, a pressure transducer, and a relief valve (not shown). The safety 136 may be in fluid communication with the exhaust 40 to automatically exhaust pressurized material expelled from the relief valve.

The pressurized material supply system 100 may also include a connection point 138 provided along and in fluid communication with, for example, the second branch 112 of the pressurized material supply line 106. The connection point 138 may provide an access point for a manual refill of the pressurized material supply 102. The pressurized material supply system 100 may also include a pressurized material filter 140, which may be provided, e.g., along and in fluid communication with the first branch 108 of the pressurized material supply line 106. The pressurized material filter 140 may filter contaminants (e.g., dust, debris, etc.) from the pressurized material and may comprise, for example, a 15-50 micron sintered filter.

The pressurized material supply 102 may, for example, be a 300 cubic foot gas cylinder that may store the pressurized material at a pressure up to, e.g., 3,000 psi. Alternatively, in embodiments not shown the pressurized material supply 102 may be a customer-provided system that may supply the pressurized material at, e.g., 20 scfm (standard cubic feet per min) and that interfaces directly with the pressurized material supply system 100 to supply the pressurized material. The pressurized material supply 102 may include a pressurized material supply regulator and/or gauge 142. Pressurized material supply regulator and/or gauge 142 may regulate and/or measure the pressure of the pressurized material provided to the first branch 108 of the pressurized material supply line 106.

As shown in FIG. 4, the alternate pressurized material supply system 100' may include features of the above-described pressurized material supply system 100; however, the alternate pressurized material supply system 100' may include additional or alternative structures that may enable recirculation of a second pressurized material between the bellows tank assembly 206 and a second pressurized material supply 144 of the alternate pressurized material supply system 100'. According to aspects of the invention, the alternate pressurized material supply system 100' may supply the second pressurized material to the bellows tank assembly 206 at consistent pressures to thereby accurately control the pressure of the coating material supplied to the spray gun 20. In addition, by utilizing the second pressurized material as the working fluid, the pressurized material supply 102 may supply pressurized material to, e.g., the pressure pot 202 at significantly lower pressures than required by the above-described pressurized material supply system 100, since the pressurized material supply 102 is no longer required to supply the working pressurized material to the bellows tank assembly 206.

The second pressurized material supply 144 may contain the second pressurized material. The second pressurized material may be a liquid suitable for serving as a working fluid in a hydraulic circuit. The second pressurized material supply 144 may include a level sensor 146 that may indicate a level of the liquid second pressurized material contained within the second pressurized material supply 144.

The pressurized material supply line 106 of the alternate pressurized material supply system 100' may include an alternate third branch 114', an alternate fourth branch 116', and a back-pressure regulation branch 148. The alternate third branch 114' may be connected at one end to the second pressurized material supply 144 and at the other end to the opening 212 of the tank 208 of the bellows tank assembly 206. The alternate third branch 114' may convey the second pressurized material from the second pressurized material supply 144 to the outer bellows chamber 210. In embodiments, the tank 208 may include an outlet 211 in fluid communication with the outer bellows chamber 210. The alternate forth branch 116' may be connected at one end to the outlet 211 of the tank 208 and at the other end to the second pressurized material supply 144. The alternate fourth branch 116' may convey the second pressurized material from the outer bellows chamber 210 and back to the second pressurized material supply 144. The back-pressure regulation branch 148 may be connected (e.g., via T-connections) at one end to the alternate third branch 114' and at the other end to the alternate fourth branch 116'. As described further below, the back-pressure regulation branch 148 may serve as a pressure regulator 104/bellows tank assembly 206 bypass.

The alternate pressurized material supply system 100' may also include, for example, a pump 150, first and second filters 152, 154, a back-pressure regulator 156, the pressure regulator 104, a pressure sensor 127, a spray pressure control manifold 160, and a purge bucket 162. The pump 150 may be provided along and in fluid communication with the alternate third branch 114'. The pump 150 may pump the second pressurized material from the second pressurized material supply 144 and may convey the second pressurized material to the pressure regulator 104. The pressure regulator 104, also provided along and in fluid communication with the alternate third branch 114', may regulate the pressure of the second pressurized material supplied to the outer bellows chamber 210. The first filter 152 may be provided along and in fluid communication with the alternate third branch 114' interposed between the second pressurized material supply 144 and an inlet of the pump 150. The second filter 154 may be provided along and in fluid communication with the alternate third branch 114' between an outlet of the pump 150 and the pressure regulator 104.

The back-pressure regulator 156 may be provided along and in fluid communication with the back-pressure regulation branch 148. The back-pressure regulation branch 148 may be connected to the alternate third branch 114' at a location upstream from an inlet of the pressure regulator 104. According to aspects of the invention, the back-pressure regulator 156 may regulate a back-pressure of the second pressurized material. That is, the back-pressure regulator 156 may regulate a pressure of the second pressurized material within the alternate third branch 144' between the outlet of the pump 150 and the inlet of the pressure regulator 104.

The pressure sensor 127 may be provided along and in fluid communication with the alternate third branch 114'. The pressure sensor 127 may work in concert with the pressure regulator 104 to control the pressure of the second pressurized material supplied to the outer bellows chamber 210, as would be readily understood by a person having ordinary skill in the art. The spray pressure control manifold 160 may be provided along and in fluid communication with the alternate second branch 116'. The spray pressure control manifold 160 may work in concert with the pressure regulator 104 to control the pressure of the second pressurized material within the outer bellows chamber 210. The purge bucket 162 may collect second pressurized material ejected from the spray pressure control manifold 160 during control of the pressure of the second pressurized material.

The coating material supply system 200 may further include a coating material supply line 220 that the coating material may flow through. The coating material supply line 220 may convey the coating material throughout the coating material supply system 200 and enable fluid and/or gas communication between various structures of the coating material supply system 200. The coating material supply line 220 may comprise, for example, seamless stainless steel tubing, PTFE SSTL braided hoses, etc., and may be rated to safely convey the pressurized material at pressures that may reach, for example, 3,000 psi. The coating material supply line 220 may include a first end 222 that may be connected to the outlet 224 of the pressure pot 202 such that the pressure pot 202 may fluidly communicate the coating material to the coating material supply line 220. The coating material supply line 220 may further include a second end 226 that may be connected to an inlet 24 of the spray gun 20 to convey coating material to the spray gun 20. The coating material supply line 220 may also include a connection 228 that is interposed between the first end 222 and the second end 226 and that connects the coating material supply line 220 to the opening 218 of the inner bellows chamber 216 of the bellows 214 to allow coating material to flow into and/or out of the bellows 214.

In embodiments not shown, the coating material supply system 200 may include a transfer pump provided along and in fluid communication with the coating material supply line 220. The transfer pump may facilitate flow of the coating material from the pressure pot 202 to the bellows tank assembly 206; however, the transfer pump may be a low-pressure pump to minimize shear of the coating material as the transfer pump pumps the coating material through the coating material supply line 220. That is, the transfer pump does not pressurize the coating material to the operating pressure at which the coating material is sprayed from the spray gun 20.

The coating material supply system 200 may further include a bellows supply valve 230 that is provided along and in fluid communication with the coating material supply line 220. The bellows supply valve 230 may be interposed between the first end 222 and the connection 228 of the coating material supply line 220. Actuation of the bellows supply valve 230, which may be automatically controlled by the controller 30, may selectively prevent or permit fluid communication between the outlet 224 of the pressure pot 202 and opening 218 of the inner bellows chamber 216 of the bellows 214. For example, the bellows supply valve 230 may be a two-way ball valve that, when opened, may permit flow of the coating material from the pressure pot 202 to the bellows 214 to fill the bellows 214 with the coating material. When closed, the bellows supply valve 230 may prevent a back flow of the coating material from the bellows 214 to, e.g., the pressure pot 202. The bellows supply valve 230 may, for example, be pneumatically, hydraulically, and/or electrically actuated.

The coating material supply system 200 may also include a spray gun supply valve 232 that is provided along and in fluid communication with the coating material supply line 220. The spray gun supply valve 232 may be interposed between the connection 228 of the coating material supply line 220 and the inlet 24 of the spray gun 20. Actuation of the spray gun supply valve 232, which may be automatically controlled by the controller 30, may selectively prevent or permit fluid communication between the opening 218 of the inner bellows chamber 216 of the bellows 214 and the inlet 24 of the spray gun 20. For example, the spray gun supply valve 232 may be a two-way ball valve that, when opened, may permit flow of the coating material from the bellows 214 to the spray gun 20 during a spray operation. When closed, the spray gun supply valve 232 may prevent flow of the coating material from the bellows 214 to the spray gun 20, e.g., during a filling of the bellows 214. The spray gun supply valve 232 may, for example, be pneumatically, hydraulically, and/or electrically actuated.

The coating material supply system 200 may further include a pressure pot scale 234 and/or a bellows tank assembly scale 236, which may each be, for example, load cells. The pressure pot scale 234 may measure a weight of the pressure pot 202 and may generate a pressure pot weight output (e.g., an electronic signal) corresponding to the weight of the pressure pot 202. The bellows tank assembly scale 236 may measure a weight of the bellows tank assembly 206 and may generate a bellows tank assembly weight output (e.g., an electronic signal) corresponding to the weight of the bellows tank assembly 206. The pressure pot scale 234 and/or the bellows tank assembly scale 236 may each be in electronic communication (e.g., via wired and/or wireless connections) with the controller 30 such that the pressure pot weight output and/or the bellows tank assembly weight output may be transmitted to the controller 30. The controller 30 may control operation of the coating system 10 based upon the pressure pot weight output and/or the bellows tank assembly weight output.

The coating material supply system 200 may further include a coating material supply 238 that may be in fluid communication with the pressure pot 202 and may supply coating material to the pressure pot 202. For example, another coating material supply line 240 may connect the coating material supply 238 to the pressure pot 202. As shown in FIG. 3, the coating material supply 238 may, for example, comprise a tank that contains the coating material and that may be rolled into the proximity of the pressure pot 202 and connected to the coating material supply line 240 to refill the pressure pot 202. In embodiments not shown, the coating material supply 238 may be integrated into the local infrastructure such that coating material may be automatically supplied to the pressure pot 202 without the need for a manual tank refill. An auxiliary supply line 164 of the pressurized material supply line 106 may be connected to the coating material supply 238 to facilitate supply of the coating material to the pressure pot 202. For example, one end of the auxiliary supply line 164 may be connected to the connection point 138 and the other end of the auxiliary supply line 164 may be connected to the coating material supply 238 to convey pressurized material may to the coating material supply 238.

The coating system 10 may also include an auxiliary supply valve 166. The auxiliary supply valve 166 may be provided along and in fluid communication with the auxiliary supply line 164 of the pressurized material supply line 106. Actuation of the auxiliary supply valve 166, which may be automatically controlled by the controller 30, may selectively prevent or permit fluid communication between the pressurized material supply 102 and the coating material supply 238. For example, the auxiliary supply valve 166 may be a two-way ball valve that, when opened, may permit flow of the pressurized material from the pressurized material supply 102 to the coating material supply 238 to facilitate supply of the coating material to the pressure pot 202. When closed, the auxiliary supply valve 166 may prevent flow of the pressurized material from the pressurized material supply 102 to the coating material supply 238. The auxiliary supply valve 166 may, for example, be pneumatically, hydraulically, and/or electrically actuated.

The coating system 10 may further include an auxiliary regulator 168 that may regulate (e.g., automatically via instruction from the controller 30) the pressure of the pressurized material supplied to the coating material supply 238. The auxiliary regulator 168 may regulate the pressure of the pressurized material supplied to the coating material supply 238 by venting the pressurized material received from the pressurized material supply 102. The auxiliary regulator 168 may regulate the pressure of the pressurized material supplied to the coating material supply 238 to a constant pressure and/or may variably control the pressure based upon instruction from the controller 30.

The coating material supply system 200 may also include a coating material supply valve 242 that is provided along and in fluid communication with the coating material supply line 240. The coating material supply valve 242 may be interposed between the coating material supply 238 and another inlet 244 pressure pot 202, which may to receive the coating material supplied from the coating material supply 238. Actuation of the coating material supply valve 242, which may be automatically controlled by the controller 30, may selectively prevent or permit fluid communication between the coating material supply 238 and the pressure pot 202. For example, the coating material supply valve 242 may be a two-way ball valve that, when opened, may permit flow of the coating material from the coating material supply 238 to the pressure pot 202 during a filling operation of pressure pot 202. When closed, the coating material supply valve 242 may terminate filling of the pressure pot 202 and may seal the pressure pot 202 to maintain the blanket of the pressurized material. The coating material supply valve 242 may, for example, be pneumatically, hydraulically, and/or electrically actuated.

The coating material supply system 200 may further include one or more filters to filter contaminants (e.g., dust, debris, etc.) from the coating material. For example, a first filter 246 may be provided along and in fluid communication with the coating material supply line 220 between the first end 222 and the connection 228. Additionally or alternatively, a second filter 248 may be provided along and in fluid communication with the coating material supply line 220 between the connection 228 and the second end 226.

The coating material supply system 200 may also include a purge valve 250 that is provided along and in fluid communication with the coating material supply line 220. The purge valve 250 may be a three-way ball valve that, when opened, may purge the coating material from the coating material supply system 200 to a purge container 252. When closed, the coating material may bypass the purge container 252 and flow from the pressure pot 202 to, e.g., the bellows tank assembly 206. The purge valve 250 may be opened and/or closed manually or automatically (i.e., at the direction of the controller 30). The purge valve 250 may, for example, be pneumatically, hydraulically, electrically, and/or manually actuated.

The spray gun 20 may further include a purge valve 26. The purge valve 26 may be, for example, a needle valve that when opened, may purge the coating material from the coating material supply system 200. The purge valve 26 may purge the coating material to, e.g., the purge container 252. When closed, the purge valve 26 may prevent the coating material from exiting the purge valve 26 to permit spraying of the coating material from the spray gun 20. The purge valve 26 may be opened and/or closed manually or automatically (i.e., at the direction of the controller 30 or via a mechanical mechanism that opens at a predetermined pressure). The purge valve 26 may, for example, be pneumatically, hydraulically, electrically, and/or manually actuated.

The controller 30 may, for example, comprise, a programmable controller, that may coordinate/automatically control aspects of the coating system 10. The controller 30 may be a programmable logic controller (PLC), a microprocessor based controller, personal computer, or another conventional control device capable of carrying out the functions described herein as understood by a person having ordinary skill in the art. For example, the controller 30 may control the pressure of coating material at the spray gun 20 via control of various aspects of the pressurized material supply system 100 and the coating material supply system 200, as described for example in the process 400 of coating the product 50. The controller 30, together with features of the pressurized material supply system 100, the coating material supply system 200, and the spray gun 20, may together comprise a Nordson iTrax® System for monitoring and controlling coating of the product 50. This system is available for purchase form Nordson Corporation and is described, at least in part, in International Publication Number WO 2005/016552 A2, published Feb. 24, 2005, which is hereby incorporated by reference in its entirety.

The controller 30 may be in electronic communication (e.g., via wired and/or wireless connections) with any of the structures of the coating system 10 that may be subject to automatic control/monitoring, including but not limited to, the pressure regulator 104, the pressure sensor 22 of the spray gun 20, etc. A human machine interface (HMI) device 32 may be operatively connected to the controller 30 in a known manner. The HMI device 32 may include input devices and controls, such as a keypad, pushbuttons, control knobs, a touch screen, etc., and output devices, such as displays and other visual indicators, that may be used by an operator to control the operation of the controller 30 and, thereby, control the operation of the coating system 10. The HMI device may further include an audio output device, such as a speaker, by which an audio alert may be communicated to an operator.

Figure 5:
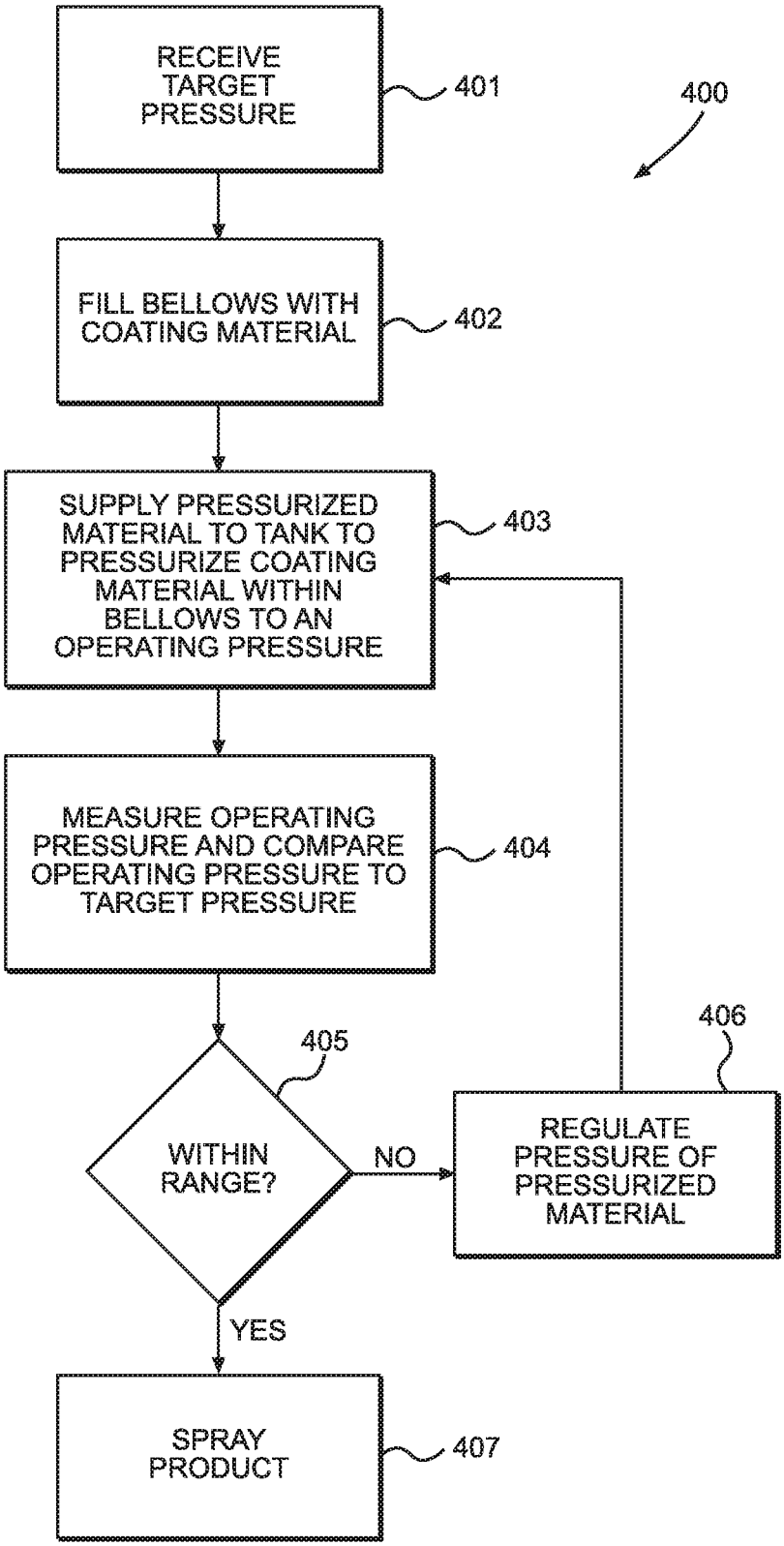
FIG. 5 illustrates a process of coating a product in accordance with aspects of the invention.

FIG. 5 shows the exemplary process 400 of coating the product 50. The exemplary process 400 may be used with any of the embodiments of the coating system 10 discussed above, and aspects of the exemplary process 400 may be automatically implemented by the controller 30. At step 401 of the process 400, a target pressure of the coating material at the spray gun 20 may be received. For example, a user may input the target pressure of the coating material to the HMI device 32 and the target pressure may be electronically communicated to the controller 30.

At step 402, the process 400 may include filling the inner bellows chamber 216 of the bellows 214, which, as described in detail above, is isolated from the outer bellows chamber 210 of the tank 208 of the bellows tank assembly 206, with a predetermined amount of the coating material. Filling the inner bellows chamber 216 of the bellows 214 may include opening the exhaust valve 122 and closing the tank supply valve 120 of the pressurized material supply system 100 in fluid communication with the outer bellows chamber 210 of the tank 208 of the bellows tank assembly 206. By opening the exhaust valve 122 and closing the tank supply valve 120, any pressurized material contained within the outer bellows chamber 210 of the tank 208 of the bellows tank assembly 206 may be allowed to freely flow from the outer bellows chamber 210 and out the exhaust 40. For the filling of the inner bellows chamber 216, the tank supply valve 120 may be closed prior to the opening of the exhaust valve 122. According to embodiments of the invention, including coating systems 10 equipped with the alternate pressurized material supply system 100', filling the inner bellows chamber 216 of the bellows 214 may include terminating or reducing the pumping of the second pressurized to the outer bellows chamber 210 by controlling operation of the pump 150 to thereby reduce the pressure of the second pressurize material within the outer bellows chamber 210. Accordingly, during the filling of the inner bellows chamber 216 the bellows 214 may be allowed to freely expand within the outer bellows chamber 210 of the tank 208 as the inner bellows chamber 216 of the bellows 214 is filled with the coating material.

Filling the inner bellows chamber 216 of the bellows 214 may further include opening the bellows supply valve 230 and closing the spray gun supply valve 232 of the coating material supply system 200 in fluid communication with the inner bellows chamber 216 of the bellows 214 to fill the inner bellows chamber 216 of the bellows 214 with the predetermined amount of the coating material. By closing the spray gun supply valve 232, the coating material may be prevented from advancing within the coating material supply line 220 and may be directed to the opening 218 of the inner bellows chamber 216 of the bellows 214 to fill the bellows 214. For the filling of the inner bellows chamber 216, the spray gun supply valve 232 may be closed prior to the opening of the bellows supply valve 230.

The filling of the inner bellows chamber 216 of the bellows 214 may further include determining that the predetermined amount of the coating material has accumulated within the inner bellows chamber 216 of the bellows 214 by measuring a weight of the bellows tank assembly 206 and determining that the measured weight corresponds to a target fill weight. For example, a target fill weight may be input into the HMI device 32 by a user and stored within the controller 30. The bellows tank assembly scale 236 may measure the weight of the bellows tank assembly 206 during filling and may generate the bellows tank assembly weight output corresponding to the weight of the bellows tank assembly 206. The bellows tank assembly weight output may be transmitted to the controller 30, which may compare to the bellows tank assembly weight output to the target fill weight and determine that the predetermined amount of coating material has accumulated within the inner bellows chamber 216 of the bellows 214 when the bellows tank assembly weight output equals or exceeds the target fill weight. Upon determining that the predetermined amount of coating material has accumulated within the inner bellows chamber 216 of the bellows 214, the controller 30 may automatically close the bellows supply valve 230 to terminate the filling of the inner bellows chamber 216 of the bellows 214.

At step 403, the process 400 may include supplying, subsequent to the filling of the inner bellows chamber 216 of the bellows 214 with the predetermined amount of the coating material, the pressurized material to the outer bellows chamber 210 of the tank 208 of the bellows tank assembly 206 to pressurize the coating material within the inner bellows chamber 216 of the bellows 214 to an operating pressure. For example, the supplying of the pressurized material to the outer bellows chamber 210 of the tank 208 of the bellows tank assembly 206 may include closing the bellows supply valve 230 and the spray gun supply valve 232 of the coating material supply system 200. By closing the bellows supply valve 230 and the spray gun supply valve 232, the coating material within the inner bellows chamber 216 of the bellows 214 may be pressurized to the operating pressure without permeating through the rest of the coating material supply system 200. The supplying of the pressurized material to the outer bellows chamber 210 of the tank 208 of the bellows tank assembly 206 may further include closing the exhaust valve 122 and opening the tank supply valve 120 to supply the outer bellows chamber 210 of the tank 208 of the bellows tank assembly 206 with the pressurized material. By closing the exhaust valve 122 and opening the tank supply valve 120, the pressurized material may be supplied to the bellows tank assembly 206 from the pressurized material supply 102 and the pressure regulator 104 at the regulated pressure while bypassing the exhaust 40. The exhaust valve 122, the bellows supply valve 230, and the spray gun supply valve 232, may each be closed prior to the opening of the tank supply valve 120.

For embodiments of the coating system 10 equipped with the alternate pressurized material supply system 100', supplying pressurized material to the outer bellows chamber 210 may include pumping the second pressurized material to the outer bellows chamber 210 at the operating pressure regulated by the pressure regulator 104.

Step 403 may further include supplying the coating material within the inner bellows chamber 216 of the bellows 214 to the spray gun 20 at the operating pressure. Supplying the coating material within the inner bellows chamber 216 of the bellows 214 to the spray gun 20 may include opening the spray gun supply valve 232.

At step 404, the process 400 may include measuring the operating pressure at the spray gun 20 and comparing the operating pressure measured at the spray gun 20 to the target pressure. For example, the pressure sensor 22 may generate a coating material pressure output (e.g., an electronic signal) corresponding to the measured pressure of the coating material supplied to the spray gun 20 and may transmit the coating material pressure output to the controller 30 for comparison to the target pressure.

At step 405, the process 400 may include determining whether the operating pressure measured at the spray gun 20 is within a predetermined control range of the target pressure (e.g., +/−5%). If the operating pressure measured at the spray gun 20 is determined to be within the predetermined control range of the target pressure, the process 400 may proceed directly to step 407. If the operating pressure measured at the spray gun 20 is determined to be outside of the predetermined control range of the target pressure, the process 400 may proceed to step 406.

At step 406, the process 400 may include regulating a pressure of the pressurized material supplied to the outer bellows chamber 210 of the tank 208 of the bellows tank assembly 206 based upon the difference between the operating pressure measured at the spray gun 20 and the target pressure. For example, if the operating pressure of the coating material is below the target pressure, the controller 30 may control the pressurized material supply system 100 or the alternate pressurized material supply system 100' to increase the regulated pressure of the pressurized material supplied to the bellows tank assembly 206, and vice versa. The process 400 may, subsequent to the regulation of the pressurized material supplied to the outer bellows chamber 210 of the tank 208 of the bellows tank assembly 206, revert back to step 403. Steps 403-406 may iteratively repeated until the operating pressure of the coating material measured at the spray gun 20 is determined to be within the predetermined control range of the target pressure.

The process 400 may conclude at step 407, whereby the product 50 may be coated by spraying the product 50 with the coating material from the spray gun 20. For example, the controller 30 may open the spray gun supply valve 232, while keeping the bellows supply valve 230 closed, to permit flow of the coating material from the bellows 214 to the spray gun 20 to spray the product 50. Spraying the product 50 with the coating material from the spray gun 20 may include, concurrently with the spraying of the product 50, measuring the weight of the bellows tank assembly 206. For example, the bellows tank assembly scale 236 may measure the weight of the bellows tank assembly 206 during spraying and may generate the bellows tank assembly weight output corresponding to the weight of the bellows tank assembly 206. The controller 30 may determine, based upon the bellows tank assembly weight output, that the weight of the bellows tank assembly 206 is less than a predetermined minimum bellows tank assembly weight and may automatically terminate spraying of the product 50 with the coating material from the spray gun 20 in response to the determination. In addition, the controller 30 may adjust the regulated pressure of the pressurized material (e.g., via control of the pressure regulator 104) based upon the bellows tank assembly weight output. For example, as the bellows tank assembly weight output decreases, the controller 30 may increase the regulated pressure of the pressurized material supplied to the bellows tank assembly 206 to compensate for the decrease of coating material in the bellows 214 and to maintain a constant pressure of the coating material at the spray gun 20 during spraying.

It will be appreciated that the foregoing description provides examples of the disclosed machine. However, it is contemplated that other implementations of the invention may differ in detail from the foregoing examples. All references to the invention or examples thereof are intended to reference the particular example being discussed at that point and are not intended to imply any limitation as to the scope of the invention more generally. All language of distinction and disparagement with respect to certain features is intended to indicate a lack of preference for those features, but not to exclude such from the scope of the invention entirely unless otherwise indicated. All methods described herein can be performed in any suitable order unless otherwise indicated herein or otherwise clearly contradicted by context.

What is claimed is:

1. A coating system, comprising:

a pressurized material supply system comprising:

a pressurized material supply that is configured to contain a pressurized material; and a pressure regulator in fluid communication with the pressurized material supply and that is configured to receive the pressurized material from the pressurized material supply and to regulate a pressure of the pressurized material to a regulated pressure;

a coating material supply system comprising:

a pressure pot that is configured to contain a coating material; and a bellows tank assembly comprising:

a tank having an outer bellows chamber configured to fluidly communicate with the pressure regulator such that the outer bellows chamber is configured to receive the pressurized material from the pressure regulator at the regulated pressure; and a bellows that is provided within the outer bellows chamber, the bellows including an inner bellows chamber that is isolated from the outer bellows chamber and that has a volume that is configured to expand or contract, the inner bellows chamber is configured to fluidly communicate with the pressure pot to receive the coating material from the pressure pot;

a spray gun that is configured to fluidly communicate with the inner bellows chamber to receive the coating material from the inner bellows chamber and to spray the coating material, the spray gun comprising a pressure sensor that is configured to measure an actual pressure of the coating material at the spray gun; and a controller that is in electronic communication with the pressure regulator and the pressure sensor, the controller is configured to control operation of the pressure regulator to adjust the regulated pressure of the pressurized material supplied to the outer bellows chamber based upon the actual pressure of the coating material measured by the pressure sensor to thereby adjust the actual pressure of the coating material at the spray gun.

2. The coating system of claim 1, wherein the pressurized material supply system further comprises a pressurized material supply line that the pressurized material is configured to flow through, the pressurized material supply line comprising:

a first branch that is connected to an opening of the pressurized material supply;

a second branch that is connected to the first branch and to an inlet of the pressure pot; and a third branch that is connected the first branch and to an opening of the outer bellows chamber, wherein the pressure regulator is provided along and in fluid communication with the third branch.

3. The coating system of claim 2, wherein the pressurized material supply system further comprises a tank supply valve that is provided along and in fluid communication with the third branch of the pressurized material supply line, the tank supply valve being interposed between the pressure regulator and the opening of the outer bellows chamber, wherein the controller is configured to control actuation of the tank supply valve to selectively prevent or permit fluid communication between the pressurized material supply and the opening of the outer bellows chamber.

4. The coating system of claim 3, wherein the pressurized material supply line further comprises a fourth branch that is connected to the third branch at a branch connection between the pressure regulator and the opening of the outer bellows chamber, wherein the fourth branch is further connected to an exhaust.

5. The coating system of claim 4, wherein the pressurized material supply system further comprises an exhaust valve that is provided along and in fluid communication with the fourth branch of the pressurized material supply line, the exhaust valve being interposed between the branch connection and the exhaust, wherein the controller is configured to control actuation of the exhaust valve to selectively prevent or permit fluid communication between the opening of the outer bellows chamber and the exhaust.

6. The coating system of claim 5, wherein the pressurized material supply system further comprises a pressure sensor provided along and in fluid communication with the third branch, the pressure sensor is configured to measure the regulated pressure of the pressurized material.

7. The coating system of claim 2, wherein the second branch includes a connection point for refilling the pressurized material supply.

8. The coating system of claim 1, wherein the coating material supply system further comprises a coating material supply line that the coating material is configured to flow through, the coating material supply line comprising:

a first end that is connected to an outlet of the pressure pot;

a second end that is connected to an inlet of the spray gun; and a connection that is interposed between the first and the second end and that connects the coating material supply line to an opening of the inner bellows chamber.

9. The coating system of claim 8, wherein the coating material supply system further comprises a bellows supply valve that is provided along and in fluid communication with the coating material supply line, the bellows supply valve being interposed between the first end and the connection of the coating material supply line, wherein the controller is configured to control actuation of the bellows supply valve to selectively prevent or permit fluid communication between the outlet of the pressure pot and the opening of the inner bellows chamber.

10. The coating system of claim 8, wherein the coating material supply system further comprises a spray gun supply valve that is provided along and in fluid communication with the coating material supply line, the spray gun supply valve being interposed between the connection of the coating material supply line and the inlet of the spray gun, wherein the controller is configured to control actuation of the spray gun supply valve to selectively prevent or permit fluid communication between the opening of the inner bellows chamber and the inlet of the spray gun.

11. The coating system of claim 1, wherein the coating material supply system further comprises a pressure pot scale that is configured to measure a weight of the pressure pot, wherein the pressure pot scale is configured to generate a pressure pot weight output corresponding to the weight of the pressure pot and to transmit the pressure pot weight output to the controller.

12. The coating system of claim 1, wherein the coating material supply system further comprises a bellows tank assembly scale that is configured to measure a weight of the bellows tank assembly, wherein the bellows tank assembly scale is configured to generate a bellows tank assembly weight output corresponding to the weight of the bellows tank assembly and to transmit the bellows tank assembly weight output to the controller.

13. The coating system of claim 1, wherein the pressure pot includes an inlet configured to fluidly communicate with the pressurized material supply such that the pressure pot is further configured to receive the pressurized material from the pressurized material supply to provide a blanket of the pressurized material above the coating material contained within the pressure pot.

14. The coating system of claim 1, wherein the pressurized material is a gas, and the pressurized material supply system further comprising a pressurized material supply line that is configured to supply the gas to the outer bellows chamber at the regulated pressure.

15. The coating system of claim 1, wherein the pressurized material is a fluid, and the pressurized material supply system further comprising a pump and a pressurized material supply line that is configured to recirculate the fluid between the pressurized material supply and the outer bellows chamber at the regulated pressure.

16. A coating system, comprising:

a supply of coating material;

a supply of pressurized gas which does not impart moisture to the coating material;

a pressurized material supply system comprising a pressure vessel having an inlet for the coating material that is connected to said supply of coating material, an outlet for the coating material, and an inlet for pressurized gas in an upper portion of the pressure vessel that is connected to the supply of pressurized gas, the pressurized gas in the upper portion of the pressure vessel pushing the coating material out of the outlet of the pressure vessel;

a bellows tank assembly that receives pressurized coating material from the outlet of the pressure vessel;

a pressure regulator that sets a pressure of the coating material in the bellows tank assembly; and a spray gun, wherein the bellows tank assembly supplies pressurized coating material to the spray gun.

17. The coating system of claim 16, wherein the pressurized gas is an inert gas.

18. The coating system of claim 16, wherein the bellows tank assembly includes a bellows that is configured to contain the coating material such that the coating material is isolated from moisture.

19. The coating system of claim 18, wherein the bellows is further configured to expand or contract to control an operating pressure of the coating material in a manner that minimizes an application of shear forces to the coating material.

20. The coating system of claim 16, wherein the supply of coating material comprises a pressure pot that is configured to contain the coating material and to supply the coating material to the bellows tank assembly, the pressure pot is further configured to receive the pressurized gas from the pressurized material supply system to provide a blanket of the pressurized gas above the coating material contained within the pressure pot.

21. The coating system of claim 16, further comprising a bellows tank assembly scale that is configured to measure a weight of the bellows tank assembly, wherein the bellows tank assembly scale is configured to generate a bellows tank assembly weight output corresponding to the weight of the bellows tank assembly and to transmit the bellows tank assembly weight output to a controller for controlling a fill operation of the bellows tank assembly.

* * * * *